US010754271B2

(12) United States Patent
Sawamoto et al.

(10) Patent No.: US 10,754,271 B2
(45) Date of Patent: Aug. 25, 2020

(54) MAGNETIC CORE MATERIAL FOR ELECTROPHOTOGRAPHIC DEVELOPER, CARRIER FOR ELECTROPHOTOGRAPHIC DEVELOPER, AND DEVELOPER

(71) Applicant: POWDERTECH CO., LTD., Kashiwa-shi, Chiba (JP)

(72) Inventors: Hiroki Sawamoto, Kashiwa (JP); Tetsuya Uemura, Kashiwa (JP)

(73) Assignee: POWDERTECH CO., LTD., Kashiwa-Shi, Chiba (JP)

( * ) Notice: Subject to any disclaimer, the term of this patent is extended or adjusted under 35 U.S.C. 154(b) by 0 days.

(21) Appl. No.: 16/474,508

(22) PCT Filed: Dec. 25, 2017

(86) PCT No.: PCT/JP2017/046426
§ 371 (c)(1),
(2) Date: Jun. 27, 2019

(87) PCT Pub. No.: WO2018/128113
PCT Pub. Date: Jul. 12, 2018

(65) Prior Publication Data

US 2019/0346783 A1 Nov. 14, 2019

(30) Foreign Application Priority Data

Jan. 4, 2017 (JP) ..... 2017-000286

(51) Int. Cl.
*G03G 9/107* (2006.01)
*G03G 9/113* (2006.01)

(52) U.S. Cl.
CPC ..... *G03G 9/107* (2013.01); *G03G 9/1131* (2013.01)

(58) Field of Classification Search
CPC ..... G03G 9/107; G03G 9/1131; G03G 9/113
See application file for complete search history.

(56) References Cited

U.S. PATENT DOCUMENTS 5,595,850 A 1/1997 Honjo et al.
6,143,456 A 11/2000 Silence et al.
(Continued)

FOREIGN PATENT DOCUMENTS

EP 1729180 A1 12/2006
EP 2557457 A1 2/2013
(Continued)

OTHER PUBLICATIONS

International Search Report and Written Opinion for related International Application No. PCT/JP2017/046426 dated Feb. 13, 2018; English translation of ISR provided; 9 pages.
(Continued)

*Primary Examiner* — Thorl Chea
(74) *Attorney, Agent, or Firm* — Procopio, Cory, Hargreaves & Savitch LLP

(57) ABSTRACT

A magnetic core material for electrophotographic developer, satisfying a value of Expression (1): a+b×10+c+d+e+f, being from 300 to 1,300, when an amount of fluorine ion is denoted by a (ppm), an amount of chlorine ion is denoted by b (ppm), an amount of bromide ion is denoted by c (ppm), an amount of nitrite ion is denoted by d (ppm), an amount of nitrate ion is denoted by e (ppm), and an amount of sulfate ion is denoted by f (ppm), which are measured by combustion ion chromatography, and having a BET specific surface area being from 0.06 to 0.25 $m^2/g$.

6 Claims, 1 Drawing Sheet

(56) References Cited

U.S. PATENT DOCUMENTS

| | | | | |
|---|---|---|---|---|
| 2006/0003248 | A1 | 1/2006 | Kobayashi et al. | |
| 2009/0246526 | A1 | 10/2009 | Sugiura et al. | |
| 2010/0055601 | A1 | 3/2010 | Sugiura et al. | |
| 2011/0212399 | A1 | 9/2011 | Suwa et al. | |
| 2011/0244389 | A1* | 10/2011 | Kojima ..... | G03G 9/107 430/111.1 |

FOREIGN PATENT DOCUMENTS

| | | | |
|---|---|---|---|
| JP | 64038759 | A | 2/1989 |
| JP | H08-022150 | A | 1/1996 |
| JP | 2006-017828 | A | 1/2006 |
| JP | 2009-234839 | A | 10/2009 |
| JP | 2010-055014 | A | 3/2010 |
| JP | 2011-180296 | A | 9/2011 |
| JP | 2011-227452 | A | 11/2011 |
| JP | 2012-181393 | A | 9/2012 |
| JP | 2012-181398 | A | 9/2012 |
| JP | 2016-025288 | A | 2/2016 |
| JP | 6319779 | B | 4/2018 |

OTHER PUBLICATIONS

Extended European Search Report for related EP App. No. 17890275.5 dated Jun. 24, 2020; 7 pages.
Office Action for related JP App. No. 2017-000286 dated Jul. 14, 2020. English translation provided; 8 pages.

* cited by examiner

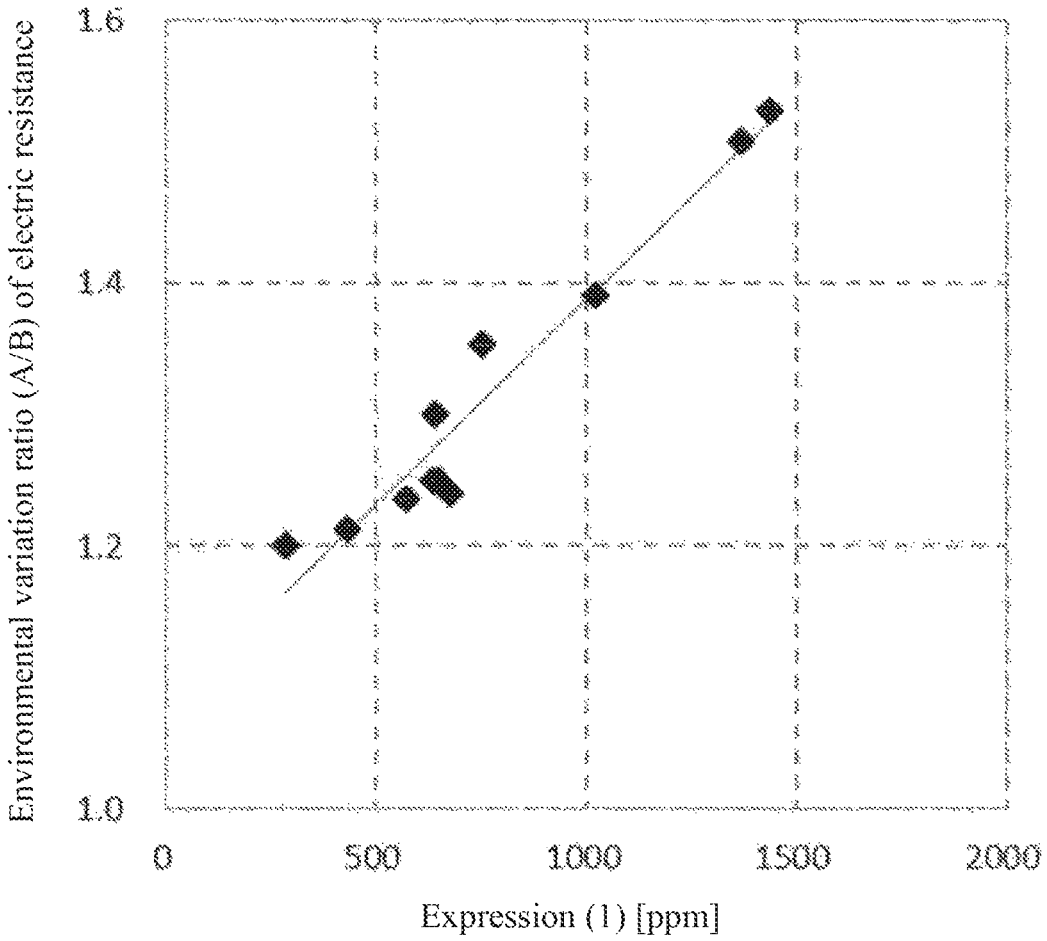
Environmental variation ratio (A/B) of electric resistance
1.6
1.4
1.2
1.0
0
500
1000
1500
2000
Expression (1) [ppm]

MAGNETIC CORE MATERIAL FOR ELECTROPHOTOGRAPHIC DEVELOPER, CARRIER FOR ELECTROPHOTOGRAPHIC DEVELOPER, AND DEVELOPER

CROSS-REFERENCE TO RELATED APPLICATIONS

This application is a U.S. National Stage entry of PCT Application No: PCT/JP2017/046426 filed on Dec. 25, 2017, which claims priority to Japanese Patent Application No. 2017-000286, filed Jan. 04, 2017, the contents of which are incorporated herein by reference.

TECHNICAL FIELD

The present invention relates to a magnetic core material for electrophotographic developer, a carrier for electrophotographic developer, and a developer.

BACKGROUND ART

The electrophotographic development method is a method in which toner particles in a developer are made to adhere to electrostatic latent images formed on a photoreceptor develop the images. The developer used in this method is classified into a two-component developer composed of a toner particle and a carrier particle, and a one-component developer using only a toner particle.

As a development method using the two-component developer composed of a toner particle and a carrier particle among those developers, a cascade method and the like were formerly employed, but a magnetic brush method using a magnet roll is now in the mainstream. In the two-component developer, a carrier particle is a carrier substance which is agitated with a toner particle in a development box filled with the developer to impart a desired charge to the toner particle, and further transports the charged toner particle to a surface of a photoreceptor to form toner images on the photoreceptor. The carrier particle remaining on a development roll to hold a magnet is again returned from the development roll to the development box, mixed and agitated with a fresh toner particle, and used repeatedly in a certain period.

In the two-component developer, unlike a one-component developer, the carrier particle has functions of being mixed and agitated with a toner particle to charge the toner particle and transporting the toner particle to a surface of a photoreceptor, and it has good controllability on designing a developer. Therefore, the two-component developer is suitable for using in a full-color development apparatus requiring a high image quality, a high-speed printing apparatus requiring reliability for maintaining image and durability, and the like. In the two-component developer thus used, it is needed that image characteristics such as image density, fogging, white spots, gradation, and resolving power exhibit predetermined values from the initial stage, and additionally these characteristics do not vary and are stably maintained during the durable printing period (i.e., a long period of time of use). In order to stably maintain these characteristics, characteristics of a carrier particle contained in the two-component developer need to be stable. As a carrier particle forming the two-component developer, various carrier such as an iron powder carrier, a ferrite carrier, a resin-coated ferrite carrier, and a magnetic powder-dispersed resin carrier have conventionally been used.

Recently, networking of offices progresses, and the time changes from a single-function copying machine to a multifunctional machine. In addition, a service system also shifts from a system where a service person who contracts to carry out regular maintenance and to replace a developer or the like to the time of a maintenance-free system. The demand for further extending the life of the developer from the market is increasing more and more.

There are some literatures focusing on such a demand. For example, Patent Literature 1 (JP-A-H08-22150) proposes a ferrite carrier for electrophotographic developer, characterized in that MnO, MgO, and $Fe_2O_3$ are partially substituted with SrO, and also describes that according to this ferrite carrier, since variation in magnetization between the ferrite carrier particles is reduced, effects including excellent image quality and durability, environment-friendliness, prolonged lifetime, and excellent environmental stability can be achieved. In addition, Patent Literature 2 (JP-A-2006-17828) proposes a ferrite carrier for electrophotographic developer, characterized by containing from 40 to 500 ppm of zirconium, and also describes that according to this ferrite carrier, occurrence of charge leakage can be prevented due to the high dielectric breakdown voltage thereof, and as a result, high image quality can be obtained.

On the one hand, as such, it has been known that the carrier properties are greatly improved by adding specific additive elements to a ferrite composition, but on the other hand, it has also been known that the carrier characteristics can also be greatly reduced by a trace amount of elements. For example, Patent Literature 3 (JP-A-2011-180296) proposes a carrier core material for electrophotographic developer which is a ferrite core material in which MnO and/or MgO is partially substituted with SrO, characterized in that the Cl concentration of the ferrite core material measured by elution method is from 0.1 to 100 ppm. It is also described that according to this carrier core material, a desired high charge amount can be achieved and an effect of small change in charge amount due to environmental variations can be obtained.

Patent Literature 4 (JP-A-2016-25288) proposes a ferrite magnetic material which includes main components containing Fe and additive elements such as Mn and has an average particle size of from 1 to 100 μm, in which a total amount of impurities excluding Fe, additive elements, and oxygen in the ferrite magnetic material is 0.5 mass % or less, and the impurities include at least two or more of Si, Al, Cr, Cu, P, Cl, Ni, Mo, Zn, Ti, sulfur, Ca, Mn, and Sr. It is described that a magnetic carrier using, as a magnetic carrier core material for electrophotographic developer, the ferrite magnetic material in which the influence of the impurities in the raw material is suppressed, has a high magnetic force and exhibits an effect of suppressing carrier scattering.

CITATION LIST

Patent Literature

Patent Literature 1: JP-A-H08-22150
Patent Literature 2: JP-A-2006-17828
Patent Literature 3: JP-A-2011-180296
Patent Literature 4: JP-A-2016-25288

SUMMARY OF INVENTION

As described above, while improvement of characteristics required for carriers, such as magnetization, electric resistance and charge characteristics, has been attempted by adding a specific additive element to the carrier core material or lowering the content of trace elements, it is hard to say that those attempts have sufficiently met the high requirements of recent years. In particular, the electric resistance is an important factor affecting image characteristics such as carrier scattering, white spots, image density, fogging, and toner scattering, and properties of the carrier core material also affect the characteristics of the carrier. Therefore, in obtaining a satisfactory image, controlling the electric resistance of the carrier core material within a preferable range is desirable. In order to suppress image defects caused by changes in use environment, lowering the environmental dependency of the electric resistance of the carrier core material is important. Furthermore, since carriers with poor strength are broken at the time of stirring with toner and the broken carriers adhere to the photoreceptor and cause image defects, imparting excellent strength to the carrier core material itself is also important.

The present inventors have this time found that in the magnetic core material for electrophotographic developer, the contents of specific anion components measured by combustion ion chromatography and the BET specific surface area are important in consideration of obtaining excellent electric resistance characteristics and strength. Specifically, they have found that by controlling the contents of specific anion components and the BET specific surface area as appropriate, change of the electric resistance caused by environmental variation is reduced, and strength and charge imparting ability become excellent, and as a result, a satisfactory image can stably be obtained when being used for a carrier or a developer.

Therefore, an object of the present invention is to provide a magnetic core material for electrophotographic developer, which has a small change of electric resistance caused by environmental variation and excellent strength and charge imparting ability, and with which a satisfactory image can stably be obtained when being used for a carrier or a developer. Another object of the present invention is to provide a carrier for electrophotographic developer and the developer including such a magnetic core material.

According to an aspect of the present invention, there is provided a magnetic core material for electrophotographic developer, satisfying a value of Expression (1): $a+b\times10+c+d+e+f$, being from 300 to 1,300, when an amount of fluorine ion is denoted by a (ppm), an amount of chlorine ion is denoted by b (ppm), an amount of bromide ion is denoted by c (ppm), an amount of nitrite ion is denoted by d (ppm), an amount of nitrate ion is denoted by e (ppm), and an amount of sulfate ion is denoted by f (ppm), which are measured by combustion ion chromatography, and having a BET specific surface area being from 0.06 to 0.25 $m^2/g$.

According to another aspect of the present invention, there is provided a carrier for electrophotographic developer including the magnetic core material for electrophotographic developer and a coating layer made of a resin provided on a surface of the magnetic core material.

According to still another aspect of the present invention, there is provided a developer including the carrier and a toner.

BRIEF DESCRIPTION OF DRAWINGS

FIG. 1 It shows a relationship between a value of Expression (1) and an environmental variation ratio of electric resistance (A/B) in a magnetic core material.

DESCRIPTION OF EMBODIMENTS

In the specification, a numerical value range represented by using "to" means a range including numerical values given before and after "to" as a lower limit value and an upper limit value, respectively.

The magnetic core material for electrophotographic developer is a particle capable of being used as a carrier core material, and the carrier core material is coated with a resin to form a magnetic carrier for electrophotographic developer. An electrophotographic developer is formed by containing the magnetic carrier for electrophotographic developer and a toner. Magnetic core material for electrophotographic developer.

The magnetic core material for a developer for electrophotography (hereinafter, also referred to as "magnetic core material" or "carrier core material" in some cases) of the present invention has a feature that the contents of specific anion components measured by combustion ion chromatography is controlled within a specific range. Specifically, when an amount of fluorine ion is denoted by a (ppm), an amount of chlorine ion is denoted by b (ppm), an amount of bromide ion is denoted by c (ppm), an amount of nitrite ion is denoted by d (ppm), an amount of nitrate ion is denoted by e (ppm), and an amount of sulfate ion is denoted by f (ppm), in the magnetic core material, the value of Expression (1): $a+b\times10+c+d+e+f$ is from 300 to 1,300. According to such a magnetic core material, a carrier having excellent electric resistance characteristics and strength can be obtained. In the case where the value of Expression (1) is more than 1,300, environmental dependency of the electric resistance becomes large. This is because the more the contents of the specific anion components (hereinafter, also simply referred to as "anion components" in some cases) are, the larger the change in electric resistance of the magnetic core material is when undergoing a change of environment. The reason for this is considered that because the anion components easily absorb environmental moisture, the moisture content of the magnetic core material increases particularly under a high-temperature and high-humidity condition, to enhance an ion conductive property, resulting in lowering of the resistance of the core material. On the other hand, in the case where the value of Expression (1) is less than 300, the fluctuation of the compression breaking strength becomes large and the durability of the carrier becomes inferior. It is considered that this is probably because if the anion components in the magnetic core material is too small in amount, the effect of inhibiting sintering becomes too small, and the crystal growth rate becomes excessively large during firing step at the time of producing the magnetic core material. It is presumed that if the crystal growth rate is excessively high, the degree of sintering varies among the particles as compared with the case where the crystal growth rate is appropriate even if the firing conditions are adjusted, resulting in a large proportion of particles having low strength. In the case where particles of low strength are used as carriers, breakage cracks due to agitation stress during durable printing period or mechanical stress such as collision of particles with each other, impact, friction, or stress occurred between particles in a development box occur, and image defects are caused by a change in electrical characteristics. In addition, in order to produce a magnetic core material having a value of Expression (1) being less than 300, it is necessary to use a raw material having high quality (low contents of anion components) or to pass through a step for increasing the quality and thus, there is a problem of poor productivity. The value of Expression (1) is preferably from 400 to 1,200, and particularly preferably from 500 to 1,100. In addition, the contents of the anion components in the magnetic core material preferably satisfy the value of Expression (2): $b\times10+f$ being from 300 to 1,300 ppm, more preferably from 400 to 1,200 ppm, and further preferably from 500 to 1,100 ppm.

The contents (ppm) of the anion components are on a weight basis.

The combustion ion chromatography is a technique in which a sample is burned in oxygen-containing gas flow, the gas generated is absorbed in an adsorption solution and then, a halogen or a sulfate ion adsorbed in the adsorption solution is quantitatively analyzed by an ion chromatography method. The technique makes it possible to easily analyze a halogen or sulfur component in ppm order which has been conventionally difficult. The contents of anion components are values measured by the combustion ion chromatography, but the detection of an anion component does not mean that it is limited to that contained in the form of an anion in the magnetic core material. For example, even when a sulfate ion is detected by a combustion ion chromatography method, it does not mean to be limited to that the magnetic core material contains a sulfur component in the form of a sulfate ion, and the sulfur component may be contained in the form of elemental sulfur, a metal sulfide, a sulfate ion, other sulfides or the like.

The values of the contents of anion components described in the present specification are values measured by the combustion ion chromatography method under the conditions described in Examples described later.

In addition, the magnetic core material of the present invention has a BET specific surface area of from 0.06 to 0.25 $m^2/g$. In the case where the BET specific surface area is less than 0.06 $m^2/g$, the effective charging area becomes small such that the charge imparting ability decreases. In the case where it exceeds 0.25 $m^2/g$, the compression breaking strength decreases. The BET specific surface area is preferably from 0.08 to 0.22 $m^2/g$, and more preferably from 0.10 to 0.20 $m^2/g$.

The value of the BET specific surface area described in the present specification is a value measured using a BET specific surface area measuring apparatus under the conditions described in Examples described later.

The BET specific surface area of the magnetic core material can be set within the above-mentioned range by adjusting the volume average particle diameter at the time of pulverizing a calcined product or the firing temperature at the time of sintering.

For example, by decreasing the volume average particle size of the calcined product, the BET specific surface area becomes large, and by increasing the volume average particle diameter, the BET specific surface area becomes small. Furthermore, as the temperature at the time of sintering increases, the BET specific surface area tends to decrease, and as the temperature at the time of the sintering decreases, the BET specific surface area tends to increase.

In order to set the BET specific surface area within the above range, the volume average particle diameter of the calcined product is preferably set to 3 μm or less, and more preferably 2 μm or less in $D_{50}$. The sintering temperature is preferably from 1,130° C. to 1,280° C., and more preferably 1,150° C. to 1,250° C.

As to the magnetic core material, as long as it functions as a carrier core material, the composition thereof is not particularly limited and one having a conventionally known composition may be used. The magnetic core material typically has a ferrite composition (ferrite particle) and preferably has a ferrite composition containing Fe, Mn, Mg, and Sr. On the other hand, in consideration of the recent trend of the environmental load reduction including the waste regulation, it is desirable that heavy metals such as Cu, Zn and Ni are not contained in a content exceeding inevitable impurities (associated impurities) range.

Particularly preferably, the magnetic core material is one having a composition represented by the formula: $(MnO)_x(MgO)_y(Fe_2O_3)_z$ in which MnO and MgO are partially substituted with SrO. Here, x=35 to 45 mol %, y=5 to 15 mol %, z=40 to 60 mol %, and x+y+z=100 mol %. By setting x to 35 mol % or more and y to 15 mol % or less, magnetization of ferrite is increased and carrier scattering is further suppressed. On the other hand, by setting x to 45 mol % or less and y to 5 mol % or more, a magnetic core having a higher charge amount can be obtained.

This magnetic core material contains SrO in its composition. Inclusion of SrO suppresses generation of low magnetization particles. In addition, together with $Fe_2O_3$, SrO forms a magnetoplumbite ferrite in a form of $(SrO).6(Fe_2O_3)$ or a precursor of a strontium ferrite (hereinafter referred to as an Sr—Fe compound), which is a cubical crystal as represented by $Sr_aFe_bO_c$ (here, $a \geq 2$, $a+b \leq c \leq a+1.5b$) and has a perovskite crystal structure, and forms a complex oxide solid-solved in $(MnO)_x(MgO)_y(Fe_2O_3)$, in a spinel structure. This complex oxide of iron and strontium has an effect of improving the charge imparting ability of the magnetic core material in mainly cooperation with magnesium ferrite which is a component containing MgO. In particular, the Sr—Fe compound has a crystal structure similar to that of $SrTiO_3$, which has a high dielectric constant, and thus contributes to high charging capacity of the magnetic core material. The substitution amount of SrO is preferably from 0.1 to 2.5 mol %, more preferably 0.1 to 2.0 mol %, and even more preferably 0.3 to 1.5 mol %, based on the total amount of $(MnO)_x(MgO)_y(Fe_2O_3)_z$. By setting the substitution amount of SrO to 0.1 mol % or more, the effect of containing SrO is further exerted. By setting to 2.5 mol % or less, excessive increases in remanent magnetization and coercive force are suppressed, and as a result, the carrier fluidity becomes better.

The volume average particle diameter ($D_{50}$) of the magnetic core material is preferably from 20 to 50 μm. By setting the volume average particle diameter to 20 μm or more, carrier scattering is further suppressed. On the other hand, by setting to 50 μm or less, the image quality is further improved. The volume average particle size is more preferably from 25 to 45 μm, and more preferably from 30 to 40 μm.

The apparent density (AD) of the magnetic core material is preferably from 1.5 to 2.5 $g/cm^3$. By setting the apparent density to 1.5 $g/cm^3$ or more, the fluidity of the carrier is improved. On the other hand, by setting to 2.5 $g/cm^3$ or less, the deterioration of charging characteristics caused by agitation stress in a developing machine is further suppressed. The apparent density is more preferably from 1.7 to 2.4 $g/cm^3$, and even more preferably from 2.0 to 2.3 $g/cm^3$.

The pore volume of the magnetic core material is preferably 25 $mm^3/g$ or less. By setting the pore volume to 25 $mm^3/g$ or less, since moisture adsorption in the atmosphere is suppressed, the change in charge amount due to environmental variation is reduced, and since impregnation of resin into the core material during resin coating is suppressed, it is not necessary to use a large amount of resin. The pore volume is more preferably from 0.1 to 20 $mm^3/g$, and more preferably from 1 to 20 $mm^3/g$.

The pore volume value described in the present specification is a value measured and calculated under the conditions described in Examples described later using a mercury porosimeter.

The magnetic core material has a logarithmic value (Log $R_{N/N}$) of the electric resistance $R_{N/N}$ (unit: Ω) under the normal temperature/normal humidity (N/N) environment being preferably from 6.0 to 10.0, more preferably from 6.5 to 9.5, and even more preferably from 7.0 to 9.0. By setting Log $R_{N/N}$ to 6.0 or more, occurrence of image white spots and carrier scattering due to charge leakage is suppressed, and by setting to be 10.0 or less, the time until the charge amount reaches the saturation value when mixed with a toner is shortened and as a result, occurrence of toner scattering immediately after toner replenishment is thereby suppressed. Here, the normal temperature/normal humidity (N/N) environment is an environment at room temperature of from 20 to 25° C. and relative humidity of from 50 to 60%, and the logarithmic value is the value of common logarithm.

In addition, the environmental variation ratio of the electric resistance (A/B) of the magnetic core material is preferably 1.5 or less, and more preferably 1.4 or less. Here, the environmental variation ratio of the electric resistance (A/B) is an index representing the change of electric resistance caused by environmental difference, and as shown in the following formula, is calculated as a ratio of the logarithmic value (Log $R_{L/L}$) of electric resistance $R_{L/L}$ (unit: Ω) under the low temperature/low humidity (L/L) environment to the logarithmic value (Log $R_{H/H}$) of electric resistance Ran (unit: Ω) under the high temperature/high humidity (H/H) environment.

$$A/B = \text{Log } R_{L/L} / \text{Log } R_{H/H} \quad \text{[Math. 1]}$$

By setting the environmental variation ratio (A/B) of the electric resistance to 1.5 or less, environmental dependence of the resistance of the core material can be reduced, and suppression of image defects caused by a change in the use environment can be sufficiently achieved. Here, the H/H environment refers to an environment at a temperature of from 30 to 35° C. and a relative humidity of from 80 to 85%, and the L/L environment refers to an environment at a temperature of from 10 to 15° C. and a relative humidity of from 10 to 15%. The lower limit of the environmental variation ratio (A/B) of the electric resistance is not particularly limited, but is typically 1.1 or more.

The average of compression breaking strength (average compression breaking strength) of the magnetic core material is preferably 200 mN or more, more preferably 230 mN or more, and even more preferably 260 mN or more. The average of compression breaking strength refers to the average of compression breaking strengths of the individual particles in a particle aggregate of the magnetic core material. By setting the average compression breaking strength to 200 mN or more, the strength as a carrier is increased, and thus the durability is further improved. Although the upper limit of the average compression breaking strength is not particularly limited, it is typically 450 mN or less.

The variation coefficient of compression breaking strength (compression breaking strength variation coefficient) of the magnetic core material is preferably 40% or less, more preferably 37% or less, and even more preferably 34% or less. The compression breaking strength variation coefficient is an index of the variation of the compression breaking strength of individual particles in a particle aggregate of the magnetic core material, and can be obtained by a method described later. By setting the variation coefficient of the compression breaking strength to 40% or less, the proportion occupied by particles with low strength can be lowered, and the strength as a carrier can be increased. Although the lower limit of the compression breaking strength variation coefficient is not particularly limited, it is typically 5% or more.

The average compression breaking strength ($CS_{ave}$) and compression breaking strength variation coefficient ($CS_{var}$) of the magnetic core material can be measured, for example, as follows. That is, an ultra-small indentation hardness tester (ENT-1100a, produced by Elionix Co., Ltd.) is used for measuring the compression breaking strength. A sample dispersed on a glass plate is set in the tester and subjected to measurement under an environment of 25° C. For the test, a flat indenter with a diameter of 50 μmϕ is used and loaded up to 490 mN at a load speed of 49 mN/s. As a particle to be used for measurement, a particle which is singly present on the measurement screen (lateral 130 μm×length 100 μm) of the ultra-micro indentation hardness tester, has a spherical shape, and of which an average value of a major axis and a minor axis when measured by software attached to ENT-1100a is volume average particle diameter ±2 μm is selected. It is presumed that the particle has broken down when the slope of the load-displacement curve approaches 0, and the load at the inflection point is taken as the compression breaking strength. The compression breaking strengths of 100 particles are measured and the compression breaking strengths of 80 pieces excluding those of 10 particles from each of the maximum value and the minimum value are employed as data to obtain the average compression breaking strength ($CS_{ave}$). Furthermore, the compression breaking strength variation coefficient ($CS_{var}$) is calculated from the following formula by calculating the standard deviation ($CS_{sd}$) for the 80 particles above.

$$CS_{var}(\%) = (CS_{sd}/CS_{ave}) \times 100 \quad \text{[Math. 2]}$$

As described above, the magnetic core material (carrier core material) for a developer for electrophotography of the present invention aims to improve charging characteristics, resistance characteristics and durability, and in which the contents of the anion components, measured by combustion ion chromatography, and the BET specific surface area are controlled. This makes it possible to obtain a carrier in which the change of electric resistance caused by environmental variation is small, and the charge imparting ability is excellent with suppressed strength and strength deviation, and thus with which a satisfactory image free of defects can be obtained. To the present inventor's knowledge, techniques for controlling the contents of anion components and the BET specific surface area have not heretofore been known.

For example, Patent Literature 3 specifies the Cl concentration measured by an elution method with an object of obtaining a high charge amount and suppressing environmental variation of the charge amount, but there is no mention about the effect of anion components other than Cl. In addition, the elution method is a technique for measuring the concentration of a component present on the particle surface, and the measurement principle is completely different from ion chromatography.

Furthermore, Patent Literature 4 aims at suppressing the carrier scattering and achieves excellent magnetic properties and suppression of carrier scattering by specifying the total amount of impurities in the ferrite magnetic material. The document 4 focuses on merely minimizing the total amount of impurities such as Si or Al as much as possible, does not teach controlling the contents of the anion components to fall within a specific range and does not disclose the BET specific surface area thereof as well.

As such, the present invention differs from Patent Literatures 3 and 4 not only in the objects but also in the effects.

Carrier for Electrophotographic Developer

The carrier for electrophotographic developer (also simply referred to as carrier) of the present invention is desirably obtained by surface-coating the surface of the magnetic core material (carrier core material) with a coating resin. Carrier characteristics may be affected by materials present on the carrier surface and properties thereof. Therefore, by surface-coating with an appropriate resin, desired carrier characteristics can precisely be imparted.

The coating resin is not particularly limited. Examples thereof include a fluorine resin, an acrylic resin, an epoxy resin, a polyamide resin, a polyamide imide resin, a polyester resin, an unsaturated polyester resin, a urea resin, a melamine resin, an alkyd resin, a phenol resin, a fluoroacrylic resin, an acryl-styrene resin, a silicone resin, and a modified silicone resin modified with a resin such as an acrylic resin, a polyester resin, an epoxy resin, a polyamide resin, a polyamide imide resin, an alkyd resin, a urethane resin, or a fluorine resin, and the like. In consideration of elimination of the resin due to the mechanical stress during usage, a thermosetting resin is preferably used. Specific examples of the thermosetting resin includes an epoxy resin, a phenol resin, a silicone resin, an unsaturated polyester resin, a urea resin, a melamine resin, an alkyd resin, resins containing them, and the like. The coating amount of the resin is preferably from 0.5 to 5.0 parts by weight with respect to 100 parts by weight of the magnetic core material (before resin coating).

Furthermore, a charge control agent may be incorporated into the coating resin. Examples of the charge control agent include various types of charge control agents commonly used for toner, and various types of silane coupling agents. The kinds of the charge control agents and coupling agents usable are not particularly limited, and preferred are a charge control agent such as a nigrosine dye, a quaternary ammonium salt, an organic metal complex, or a metal-containing monoazo dye, an aminosilane coupling agent, a fluorine-based silane coupling agent, and the like.

A toner having a negative polarity has become mainstream recently and thus, a carrier having a positive polarity is required. Examples of a material having a strong positive polarity include amine compounds. The amine compounds have a strong positive polarity and are capable of making the toner sufficiently negative, and thus considered to be an effective material. There are various compounds that may be used as such an amine compound. Examples thereof include aminosilane coupling agents, amino-modified silicone oils, and quaternary ammonium salts. Among such amine compounds, aminosilane coupling agents are particularly preferred.

As the aminosilane coupling agent, any of a primary amine, a secondary amine, or a compound containing both of them can be used. Examples thereof that may be suitably used include N-2(aminoethyl)3-aminopropylmethyldimethoxysilane. N-2(aminoethyl)3-aminopropyltrimethoxysilane, N-2(aminoethyl)3-aminopropyltriethoxysilane, N-aminopropyltrimethoxysilane, N-aminopropyltriethoxysilane, 3-triethoxysilyl-N-(1,3-dimethyl-butylidene)propylamine, and N-phenyl-3-aminopropyltrimethoxysilane.

In the case where the amine compound is used in a mixture with a resin, it is desirably contained in the coating resin solid content in an amount of 2 to 50% by weight. In the case where the amine compound content is less than 2% by weight, inclusion effect is not exhibited, and even if it is contained in an amount exceeding 50% by weight, a further improved inclusion effect cannot be obtained, which is economically disadvantageous. Furthermore, in the case where the amount of the amine compound is too large, problems may occur in the compatibility with the coating resin, which is not preferable because a nonhomogeneous resin mixture is likely to be formed.

Other than the use where the amine compound is added to the coating resin which acts as the base, as described above, an amino group may also be modified in the base resin in advance. Examples of such include amino-modified silicone resins, amino group-containing acrylic resins, and amino group-containing epoxy resins. These resins may be used singly or in mixture with other resins. In the case of using the amino group-modified resin or a mixture of the amino group-modified resin with another resin, the amount of the amino group present in the entire resin is appropriately determined according to the charging ability compatibility or the like thereof.

For the purpose of controlling the carrier properties, a conductive agent may be added to the coating resin in addition to the charge control agent. The addition amount thereof is from 0.25 to 20.0% by weight, preferably 0.5 to 15.0% by weight, and particularly preferably 1.0 to 10.0% by weight with respect to the solid content of the coating resin. Examples of the conductive agents include conductive carbon, oxides such as tin oxide and titanium oxide, and various organic conductive agents.

The carrier has a logarithmic value (Log $R_{N/N}$) of the electric resistance $R_{N/N}$ (unit: Ω) under the normal temperature/normal humidity (N/N) environment being preferably from 7.0 to 13.0, more preferably from 7.5 to 12.5, and even more preferably from 8.0 to 12.0. By setting Log $R_{N/N}$ to be 7.0 or more, occurrence of image white spots and carrier scattering due to charge leakage is suppressed, and by setting to be 13.0 or less, the time until the charge amount reaches the saturation value when mixed with a toner is shortened and as a result, occurrence of toner scattering immediately after toner replenishment is thereby suppressed.

In addition, the environmental variation ratio of the electric resistance (C/D) of the carrier is preferably 1.5 or less, and more preferably 1.4 or less. Here, the environmental variation ratio of the electric resistance (C/D) is calculated as a ratio of the logarithmic value (Log $R_{L/L}$) of electric resistance $R_{L/L}$ (unit: Ω) under the low temperature/low humidity (L/L) environment to the logarithmic value (Log $R_{H/H}$) of electric resistance $R_{H/H}$ (unit: Ω) under the high temperature/high humidity (H/H) environment.

$$C/D = \text{Log } R_{L/L} / \text{Log } R_{H/H} \quad \text{[Math. 3]}$$

By setting the environmental variation ratio (C/D) of the electric resistance to 1.5 or less, environmental dependence of the resistance of the carrier can be reduced, and suppression of image defects caused by a change in the use environment can sufficiently be achieved. The lower limit of the environmental variation ratio (C/D) of the electric resistance is not particularly limited, but is typically 1.1 or more.

The charge amount of the carrier is preferably from 20 to 80 μC/g, more preferably from 30 to 70 μC/g, and even more preferably from 40 to 60 μC/g. The charge amount within the above range can make the charging characteristics of the carrier more proper and improve image characteristics.

Methods for Producing Magnetic Core Material for Electrophotographic Developer and Carrier for Electrophotographic Developer:

In producing a carrier for electrophotographic developer of the present invention, first, a magnetic core material for electrophotographic developer is produced. For producing the magnetic core material, primary materials are weighed in appropriate amounts, and then pulverized and mixed by a ball mill, a vibration mill or the like for 0.5 hours or more, preferably from 1 to 20 hours. The raw materials are not particularly limited, but desirably selected so as to achieve a composition containing the above-described elements.

The pulverized product thus obtained is pelletized by using a pressure molding machine or the like and then calcined at a temperature of from 700 to 1,300° C. Granulation may be carried out without using the pressure molding machine, but by adding water after crushing to form a slurry and using a spray dryer. After the calcining, the mixture is further pulverized with a ball mill, a vibration mill or the like, and then water and, if necessary, a dispersant, a binder and the like are added thereto, and after the viscosity is adjusted, granulation is carried out by granulating in a spray dryer. In pulverizing after calcining, water may be added and pulverization may be carried out with a wet ball mill, a wet vibration mill or the like.

The pulverizer such as the above-mentioned ball mill and vibration mill is not particularly limited, but in order to effectively and evenly disperse the raw materials, using fine beads having a particle size of 1 mm or less as the medium to be used is preferable. The degree of pulverization can be controlled by adjusting the particle size of the beads to be used, composition, and pulverizing time.

Thereafter, the obtained granulated product is held at a temperature of from 800 to 1,500° C. for from 1 to 24 hours in an atmosphere in which oxygen concentration is controlled, to thereby carry out sintering. At that time, a rotary electric furnace, a batch electric furnace, a continuous electric furnace, or the like may be used, and oxygen concentration of the atmosphere during sintering may be controlled by blowing an inert gas such as nitrogen or a reducing gas such as hydrogen or carbon monoxide thereinto.

The sintered product thus-obtained is disintegrated and classified. As the classification method, the existing method such as an air classification method, a mesh filtration method or a precipitation method is used to regulate the particle size to an intended particle size.

Thereafter, if desired, an oxide film treatment can be performed by applying low temperature heating to the surface, thereby regulating the electric resistance. The oxide film treatment can be performed by heat treatment, for example, at 300 to 700° C. by using a common rotary electric furnace, batch electric furnace or the like. The thickness of the oxide film formed by the treatment is preferably from 0.1 nm to 5 μm. In the case of 0.1 nm or more, the effect of the oxide film layer can be sufficient. In the case of 5 μm or less, decrease in the magnetization or the excessively high resistance is suppressed. If desired, reduction may be performed before the oxide film treatment. As described above, the magnetic core material is prepared As the method for adjusting the contents of the anion components, measured by the combustion ion chromatography, in a magnetic core material, various techniques can be mentioned. Examples thereof include using a raw material having a small contents of the anion components, and performing washing operation in the stage of slurry (suspension containing the calcined product and water) before granulation. In addition, it is also effective to increase a flow rate of atmospheric gas introduced into a furnace at the time of calcination or sintering to make anions be easily discharged outside the system. In particular, the washing operation of slurry is preferably performed, and this can be performed, for example, by a technique in which after dehydration of the slurry, water is added again and wet pulverization is performed. In order to reduce the contents of the anion components, the dehydration and re-pulverization may be repeated.

As described above, it is desired that after the production of the magnetic core material, the surface of the magnetic core material is coated with a resin to from a carrier. The coating resin used is that described above. In many cases, carrier characteristics are affected by materials present on the carrier surface and properties thereof. Therefore, by surface-coating with an appropriate resin, desired carrier characteristics can precisely be adjusted. As a coating method, coating can be performed by a known method, for example, a brush coating method, a dry method, a spray dry system using a fluidized bed, a rotary dry system, or a dip-and-dry method using a universal agitator. In order to improve the surface coverage, the method using a fluidized bed is preferred. In the case where the resin is baked after the coating, any of an external heating system and an internal heating system may be employed, and, for example, a fixed or fluidized electric furnace, a rotary electric furnace or a burner furnace can be used. Alternatively, the baking with a microwave may be used. In the case where a UV curable resin is used as the coating resin, a UV heater is employed. The temperature for baking is varied depending on the resin used, but it is necessary to be a temperature equal to or higher than the melting point or the glass transition point. For a thermosetting resin, a condensation-crosslinking resin or the like, the temperature is necessarily raised to a temperature at which the curing sufficiently progresses.

Developer:

The developer according to the present invention contains the carrier for electrophotographic developer described above and a toner. The particulate toner (toner particle) constituting the developer includes a pulverized toner particle produced by a pulverizing method and a polymerized toner particle produced by a polymerization method. The toner particle used in the present invention may be toner particles obtained by any method.

The pulverized toner particles can be obtained, for example, by thoroughly mixing a binder resin, a charge control agent and a coloring agent with a mixer such as a Henschel mixer, subsequently, melt-kneading in a twin-screw extruder or the like, then, cooling, pulverizing, classifying, adding external additives such as silica powder and titania, and then mixing with a mixer or the like.

The binder resin constituting the pulverized toner particles is not particularly limited. Examples thereof include polystyrene, chloropolystyrene, styrene-chlorostyrene copolymer, styrene-acrylate ester copolymer, and styrene-methacrylate ester copolymer, as well as rosin-modified maleic acid resin, epoxy resin, polyester resin, polyurethane resin and the like. They may be used alone or in combination.

As the charge control agent, any agent can be used. For example, for positively chargeable toners, nigrosine dyes, quaternary ammonium salts and the like can be mentioned, and for negatively chargeable toners, metal-containing monoazo dyes and the like can be mentioned.

As the coloring agent (colorant), conventionally known dyes and pigments can be used. For example, use can be made of carbon black, phthalocyanine blue, permanent red, chrome yellow, phthalocyanine green, and the like. In addition, external additives such as silica powder, titania and the like for improving fluidity and cohesion resistance of the toner may be added according to the toner particles.

Polymerized toner particles are toner particles produced by known methods such as a suspension polymerization method, an emulsion polymerization method, an emulsion aggregation method, an ester elongation polymerization method, and a phase inversion emulsification method. As for such polymerized toner particles, for example, a colored dispersion prepared by dispersing a coloring agent in water by using a surfactant is mixed with a polymerizable monomer, a surfactant and a polymerization initiator in an aqueous medium under stirring, the polymerizable monomers are emulsified and dispersed in an aqueous medium, polymerization is performed under stirring and mixing, and then, the polymer particles are salted out by adding a salting-out agent. The particles obtained by the salting-out are filtrated, washed and dried, to thereby obtain the polymerized toner particles. Thereafter, an external additive such as silica powder and titania is added to the dried toner particles as required.

Furthermore, when producing the polymerized toner particles, a fixing property improving agent and a charge controlling agent can be blended in addition to the polymerizable monomer, surfactant, polymerization initiator, and coloring agent such that various properties of the obtained polymerized toner particles can be controlled and improved. Furthermore, in order to improve the dispersibility of the polymerizable monomer in the aqueous medium and to adjust the molecular weight of the obtained polymer, a chain transfer agent can be used.

The polymerizable monomer used for producing the polymerized toner particles is not particularly limited. Examples thereof include styrene and its derivatives; ethylenically unsaturated monoolefins such as ethylene and propylene; halogenated vinyls such as vinyl chloride, vinyl esters such as vinyl acetate; α-methylene aliphatic monocarboxylic acid esters such as methyl acrylate, ethyl acrylate, methyl methacrylate, ethyl methacrylate, 2-ethylhexyl methacrylate, dimethylamino acrylate, and diethylamino methacrylate.

Conventionally known dyes and pigments can be used as the coloring agent (coloring material) used in preparing the polymerized toner particles. For example, carbon black, phthalocyanine blue, permanent red, chrome yellow, phthalocyanine green, and the like can be used. The surface of the coloring agent may have been modified with a silane coupling agent, a titanate coupling agent or the like.

An anionic surfactant, a cationic surfactant, an amphoteric surfactant, and a nonionic surfactant can be used as the surfactant used for producing the polymerized toner particles.

Examples of the anionic surfactant include aliphatic acid salts such as sodium oleate and castor oil, alkyl sulfate esters such as sodium lauryl sulfate and ammonium lauryl sulfate, alkyl benzene sulfonates such as sodium dodecyl benzene sulfonate, alkyl naphthalene sulfonate salts, alkylphosphorate ester salts, naphthalenesulfonate formaldehyde condensate, polyoxyethylene alkylsulfurate ester salts, and the like. Examples of the nonionic surfactant include polyoxyethylene alkyl ether, polyoxyethylene aliphatic acid ester, sorbitan aliphatic acid ester, polyoxyethylene alkylamine, glycerin, aliphatic acid ester, oxyethylene-oxypropylene block polymer, and the like. Furthermore, examples of the cationic surfactant include alkylamine salts such as laurylamine acetate, quaternary ammonium salts such as lauryltrimethylammonium chloride and stearyltrimethylanmmonium chloride, and the like. Examples of the amphoteric surfactants include aminocarboxylic acid salts, alkyl amino acids, and the like.

The surfactant as described above can usually be used in an amount within the range of from 0.01 to 10% by weight based on the polymerizable monomer. The use amount of such a surfactant affects the dispersion stability of monomers and also affects the environmental dependency of the obtained polymerized toner particles, and thus it is preferable to use in an amount within the above-described range in which the dispersion stability of monomers is secured and the environment dependency of the polymerized toner particles is hardly affected excessively.

In the production of the polymerized toner particles, a polymerization initiator is usually used. The polymerization initiator includes a water-soluble polymerization initiator and an oil-soluble polymerization initiator, and any of them may be used in the present invention. Examples of the water-soluble polymerization initiator that can be used in the present invention include persulfates such as potassium persulfate and ammonium persulfate, and water-soluble peroxide compounds. Examples of the oil-soluble polymerization initiator include azo compounds such as azobisisobutyronitrile and oil-soluble peroxide compounds.

In the case where a chain transfer agent is used in the present invention, examples of the chain transfer agent include mercaptans such as octyl mercaptan, dodecyl mercaptan and tert-dodecyl mercaptan, carbon tetrabromide, and the like.

Furthermore, in the case where the polymerized toner particles used in the present invention contain a fixing property improver, natural wax such as carnauba wax, and olefinic wax such as polypropylene and polyethylene, and the like can be used as the fixing property improver.

In addition, in the case where the polymerized toner particles used in the present invention contain a charge control agent, there is no particular limitation on the charge control agent to be used, and a nigrosine dye, a quaternary ammonium salt, an organometallic complex, a metal-containing monoazo dye, and the like can be used.

Furthermore, example of the external additives used for improving fluidity of the polymerized toner particles and the like include silica, titanium oxide, barium titanate, fluororesin fine particles, acrylic resin fine particles, and the like, and they may be used alone or in combination.

In addition, as the salting-out agent used for separating polymerized particles from an aqueous medium, metal salts such as magnesium sulfate, aluminum sulfate, barium chloride, magnesium chloride, calcium chloride, and sodium chloride can be mentioned.

The average particle diameter of the toner particles produced as described above is in the range of from 2 to 15 μm, and preferably from 3 to 10 μm, and the polymerized toner particles have higher particle uniformity than the pulverized toner particles. By setting the average particle diameter to 2 μm or more, the charging ability is improved, and fogging and toner scattering are further suppressed. By setting to 15 μm or less, the image quality is further improved.

An electrophotographic developer can be obtained by mixing the carrier and toner produced as described above. The mixing ratio of the carrier and the toner, that is, the toner concentration is preferably set to 3 to 15% by weight. By setting the toner concentration to 3% by weight or more, a desired image density can be easily obtained. By setting to 15% by weight or less, toner scattering and fogging are further suppressed.

A developer obtained by mixing the carrier and toner produced as described above may be used as a replenishment developer. In this case, regarding the mixing ratio of the carrier and the toner, the toner is mixed at a ratio of 2 to 50 parts by weight with respect to 1 part by weight of the carrier.

The developer according to the present invention prepared as described above can be used in a copying machine, a printer, a FAX machine, a printing machine, and the like, which use a digital system employing a development system in which an electrostatic latent image formed on a latent image holder having an organic photoconductive layer is reversely developed with a magnetic brush of a two-component developer containing a toner and a carrier while applying a bias electric field. Furthermore, the developer is also applicable to a full-color machine and the like using an alternative electric field, which is a method in which when applying a development bias from a magnetic brush to an electrostatic latent image side, an AC bias is superimposed on a DC bias.

EXAMPLE

The present invention will be described more specifically with reference to the examples below.

Example 1

(1) Preparation of Magnetic Core Material (Carrier Core Material)

The raw materials were weighed so as to be 39.6 mol % of MnO, 9.6 mol % of MgO, 50 mol % of $Fe_2O_3$, and 0.8 mol % of SrO, and pulverized and mixed for 5 hours with a dry media mill (vibration mill, ⅛ inch diameter stainless steel beads), and the obtained pulverized product was made into pellets of about 1 mm square by a roller compactor. Used were 34.2 kg of $Fe_2O_3$ as a raw material, 12.9 kg of trimanganese tetraoxide as a MnO raw material, 2.4 kg of magnesium hydroxide as a MgO raw material, and 0.5 kg of strontium carbonate as a SrO raw material, respectively.

(1-1) Pulverization of Calcined Product

Coarse powder was removed from this pellet by using a vibration sieve with an opening of 3 mm, then fine powder was removed by using a vibration sieve with an opening of 0.5 mm and then, calcining was carried out by heating at 1,200° C. for 3 hours by using a continuous electric furnace. Next, after pulverizing to an average particle diameter of about 5 μm by using a dry media mill (vibration mill, ⅛ inch diameter stainless steel beads) over 6 hours, water was added thereto, and further pulverization was carried out by using a wet media mill (horizontal bead mill, 1 mm diameter zirconia beads) for 4 hours. The resulting slurry was squeezed and dehydrated by a belt press machine, water was added to the cake, and pulverization was carried out by using the wet media mill (horizontal bead mill, 1 mm diameter zirconia beads) again for 4 hours to obtain Slurry 1. The particle size (volume average particle diameter of the pulverized material) of the particles in Slurry 1 was measured by Microtrack, and $D_{50}$ thereof was found about 2 μm.

(1-2) Granulation

To Slurry 1 obtained was added PVA (aqueous 10% by weight solution) as a binder in an amount of 0.4% by weight based on the solid content, a polycarboxylic acid dispersant was added so as to attain a slurry viscosity of 2 poise, the granulation and drying were carried out by using a spray drier, and the particle size control of the obtained particles (granulated material) was performed by a gyro shifter. Thereafter, the granulated product was heated at 750° C. for 2 hours by using a rotary electric furnace in the air atmosphere to remove organic components such as the dispersant and the binder.

(1-3) Sintering

Thereafter, the granulated product was held in a tunnel electric furnace at a firing temperature of 1,180° C. and an oxygen concentration of 0.6% by volume for 5 hours to obtain a fired product. At this time, the temperature rising rate was set to 150° C./h and the cooling rate was set to 110° C./h. Also, nitrogen gas was introduced from an outlet side of the tunnel electric furnace, and the internal pressure of the tunnel electric furnace was set to from 0 to 10 Pa (positive pressure). Thereafter, the fired product was disintegrated with a hammer crusher, further classified with a gyro shifter and a turbo classifier to adjust the particle size, and subjected to magnetic separation to separate a low magnetic force product, thereby obtaining ferrite particles (magnetic core material).

(2) Preparation of Carrier

An acrylic resin (BR-52, manufactured by Mitsubishi Rayon Co., Ltd.) was dissolved in toluene to prepare an acrylic resin solution having a resin concentration of 10%. By using a universal mixing agitator, 100 parts by weight of the ferrite particles (magnetic core material) obtained in (1-3) and 10 parts by weight of the acrylic resin solution (1.0 parts by weight as a solid content because of its resin concentration of 10%) were mixed and stirred, to thereby coat the surface of the ferrite particles with the resin while volatilizing toluene. After confirming that the toluene was thoroughly volatilized, the residue was taken out from the apparatus, placed in a vessel, and subjected to a heat treatment at 150° C. for 2 hours in a hot air heating oven. Thereafter, the product was cooled to room temperature, ferrite particles with the resin cured were taken out, aggregation of the particles was removed with a vibrating sieve having an opening size of 200 mesh, and non-magnetic substances were removed by using a magnetic separator. Thereafter, coarse particles were again removed by the vibrating sieve having an opening size of 200 mesh, to obtain a ferrite carrier coated with resin.

(3) Evaluation

As to the magnetic core material and carrier obtained, evaluations of various characteristics were made in the manner described below.

<Volume Average Particle Size>

The volume average particle size ($D_{50}$) of the magnetic core material was measured by using a micro-track particle size analyzer (Model 9320-X100, produced by Nikkiso Co., Ltd.). Water was used as a dispersion medium. First, 10 g of a sample and 80 ml of water were put into a 100-mil beaker and a few drops of a dispersant (sodium hexametaphosphate) was added thereto. Subsequently, the mixture was dispersed for 20 seconds by using an ultrasonic homogenizer (UH-150 Model, produced by SMT. Co., Ltd.) at an output power level set at 4. Thereafter, foams formed on a surface of the beaker were removed, and the sample was loaded in the analyzer to perform the measurement.

<Apparent Density>

The apparent density (AD) of the magnetic core material was measured in accordance with JIS Z2504 (Test Method for Apparent Density of Metal Powders).

<Pore Volume>

The pore volume of the magnetic core material was measured by using mercury porosimeters (Pascal 140 and Pascal 240, produced by Thermo Fisher Scientific Inc.). A dilatometer CD3P (for powder) was used, and a sample was put in a commercially available gelatin capsule with a plurality of bored holes and the capsule was placed in the dilatometer. After deaeration in Pascal 140, mercury was charged, and a measurement in the low pressure region (0 to 400 kPa) was performed. Next, a measurement in the high pressure region (from 0.1 MPa to 200 MPa) was performed by Pascal 240. After the measurements, the pore volume of the ferrite particle was determined from data (the pressure and the mercury intrusion amount) for pore diameter of 3 μm or less converted from pressure. For determining the pore diameter, a control-cum-analysis software (PASCAL 140/240/440) associated with the porosimeter was used, and the calculation was carried out with the surface tension of mercury set at 480 dyn/cm and the contact angle set at 141.3°.

<BET Specific Surface Area>

The BET specific surface area of the magnetic core material was measured by using a BET specific surface area measuring apparatus (Macsorb HM model 1210, produced by Mauntec Corporation). A measurement sample was placed in a vacuum dryer, treated at 200° C. for 2 hours, held in the dryer until the temperature reached 80° C. or lower, and then taken out of the dryer. Thereafter, the sample was filled densely in a cell and set in the apparatus. The pretreatment was carried out at a degassing temperature of 200° C. for 60 minutes and then measurement was carried out.

<Ion Content>

The measurement of the contents of the anion components in the magnetic core material was performed by quantitative analysis under the following conditions by combustion ion chromatography.

Combustion equipment: AQF-2100H, produced by Mitsubishi Chemical Analytic Tech Co., Ltd.)
Sample amount: 50 mg
Combustion temperature: 1,100° C.
Combustion time: 10 minutes
Ar flow rate: 400 ml/min
$O_2$ flow rate: 200 ml/min
Humidified air flow rate: 100 ml/min
Absorption solution: Solution prepared by adding 1% by weight of hydrogen peroxide to the eluent described below
Analysis equipment: IC-2010, produced by Tosoh Corp.
Column: TSKgel SuperIC-Anion HS (4.6 mm I.D.×1 cm+4.6 mm I.D.×10 cm)
Eluent: Aqueous solution prepared by dissolving 3.8 mmol of $NaHCO_3$ and 3.0 mmol of $Na_2CO_3$ in IL of pure water
Flow rate: 1.5 ml/min
Column temperature: 40° C.
Injection volume: 30 μL
Measurement mode: Suppressor system
Detector: CM detector
Standard sample: Anion mixed standard solution produced by Kanto Chemical Co., Inc.

Meanwhile, the measurement of the contents of cation components in the magnetic core material was performed in the following manner. First, an acid solution was added to the ferrite particles and heated to completely dissolve the ferrite particles. Subsequently, quantitative analysis of the dissolved solution was performed by using an ICP emission spectrometer (ICPS-1000) IV, produced by Shimadzu Corporation), and the analysis result was converted into the contents in the ferrite particles.

<Electric Resistance>

The electric resistance characteristics of the magnetic core material and the carrier under the normal temperature and normal humidity (N/N) environment, under the high temperature and high humidity (H/H) environment and under the low temperature and low humidity (L/L) environment were respectively obtained as follows.

First, the electric resistance ($R_{N/N}$) of the magnetic core material under the N/N environment was measured as follows. That is, nonmagnetic parallel plate electrodes (10 mm×40 mm) were faced to each other with an interval between the electrodes of 2.0 mm, and 200 mg of the sample was weighed and filled into the gap. Next, the sample was held between the electrodes by attaching a magnet (surface magnetic flux density: 1,500 Gauss, area of the magnet in contact with the electrode: 10 mm×30 mm) to the parallel plate electrode, a voltage of 100V was applied, the electric resistance $R_{N/N}$ (unit: Ω) was measured with an insulation resistance meter (SM-8210, produced by DKK-TOA Corporation), and the logarithmic value (Log $R_{N/N}$) thereof was obtained. Here, the normal temperature and normal humidity refers to an environment at a room temperature of from 20 to 25° C. and a humidity of from 50 to 60%, and the above measurement was carried out after exposing the sample to the constant temperature and humidity chamber controlled to the above-described room temperature and humidity for 12 hours or more.

The electric resistance ($R_{H/H}$) of the magnetic core material under the H/H environment was measured as follows. That is, the sample was exposed for 12 hours or more in a chamber in which the chamber temperature and humidity were controlled such that the temperature was from 30 to 35° C. and the relative humidity was from 80 to 85% as the H/H environment, then the electric resistance $R_{H/H}$ (unit: Ω) was measured in the same manner as in the above-mentioned electric resistance under the normal temperature and normal humidity, and the logarithmic value (Log $R_{H/H}$) thereof was obtained. At this time, the interval between the electrodes was 2.0 mm and the applied voltage was 100V.

The electric resistance ($R_{L/L}$) of the magnetic core material under the L/L environment was measured as follows. That is, the sample was exposed for 12 hours or more in a chamber in which the chamber temperature and humidity were controlled such that the temperature was from 10 to 15° C. and the relative humidity was from 10 to 15% as the L/L environment, then the electric resistance $R_{L/L}$ (unit: Ω) was measured in the same manner as in the above-mentioned electric resistance under the normal temperature and normal humidity, and the logarithmic value (Log $R_{L/L}$) thereof was obtained. At this time, the interval between the electrodes was 2.0 mm and the applied voltage was 100V.

Then, by using the Log $R_{H/H}$ and Log $R_{L/L}$, the environmental variation ratio (A/B) of the electric resistance of the magnetic core material was obtained from the following formula.

$$A/B = \text{Log } R_{L/L} / \text{Log } R_{H/H} \quad \text{[Math. 4]}$$

Also, the electric resistances ($R_{N/N}$, $R_{H/H}$ and $R_{L/L}$) under the N/N environment, under the H/H environment and under the L/L environment of the carriers were measured in the same manner as in the magnetic core materials, and the environmental variation ratio (C/D) of the electric resistance of the carrier was obtained from the following formula.

$$C/D = \text{Log } R_{L/L} / \text{Log } R_{H/H} \quad \text{[Math. 5]}$$

<Compression Breaking Strength>

The average compression breaking strength ($CS_{ave}$) and the compression breaking strength variation coefficient ($CS_{var}$) of the magnetic core material were determined as follows. First, by using an ultra-small indentation hardness tester (ENT-1100a, produced by Elionix Co., Ltd.), a sample dispersed on a glass plate was set in the tester and the compression breaking strength was measured under an environment of 25° C. For the test, a flat indenter with a diameter of 50 μmϕ was used and loaded up to 490 mN at a load speed of 49 mN/s. As a particle to be used for the measurement, a particle which was singly present on the measurement screen (lateral 130 μm×length 100 μm) of the ultra-micro indentation hardness tester, had a spherical shape, and of which an average value of a major axis and a minor axis when measured by software attached to ENT-1100a was volume average particle diameter ±2 μm was selected. It was presumed that the particle had broken down when the slope of the load-displacement curve approached 0, and the load at the inflection point was taken as the compression breaking strength. The compression breaking strengths of 100 particles were measured and the compression breaking strengths of 80 pieces excluding those of 10 particles from each of the maximum value and the minimum value were employed as data to obtain the average compression breaking strength ($CS_{ave}$). Furthermore, the compression breaking strength variation coefficient ($CS_{var}$) was calculated from the following formula by calculating the standard deviation ($CS_{sd}$) for the 80 particles above.

$$CS_{var}(\%)=(CS_{sd}/CS_{ave})\times 100 \quad \text{[Math. 6]}$$

<Charge Amount>

The measurement of the charge amount of the carrier was performed in the following manner. First, a carrier and a commercially available negatively chargeable toner (cyan toner for DocuPrint C3530, produced by Fuji Xerox Co., Ltd.) used in full-color printer were weighed so as to attain the toner concentration of 8.0% by weight and the total weight of 50 g. The carrier and toner weighed were exposed under the normal temperature and normal humidity environment of temperature from 20 to 25° C. and humidity from 50 to 60% for 12 hours or more. Then, the sample and toner were charged into a 50-cc glass bottle and agitated at a rotation frequency of 120 rpm for 15 minutes to form a developer. On the other hand, as a charge amount measuring apparatus, use was made of an apparatus having a magnet roll including a total of 8 poles of magnets (magnetic flux density: 0.1 T) which N poles and S poles were alternately arranged on an inner side of an aluminum bare tube (hereinafter, a sleeve) of a cylindrical shape of 31 mm in diameter and 76 mm in length, and a cylindrical electrode arranged in an outer circumference of the sleeve with a gap of 5.0 mm from the sleeve. On the sleeve was uniformly adhered 0.5 g of the developer and then, while the magnet roll on the inner side was rotated at 100 rpm with the outer-side aluminum bare tube being fixed, a direct current voltage of 2,000 V was applied for 60 seconds between the outer electrode and the sleeve to transfer the toner to the outer-side electrode. At this time, an electrometer (an insulation resistance tester, Model 6517A, produced by Keithley Instruments, Inc.) was connected to the cylindrical electrode to measure the charge amount of the toner transferred. After the elapse of 60 seconds, the voltage applied was shut off, and after the rotation of the magnet roll was stopped, the outer-side electrode was taken out and the weight of the toner transferred to the electrode was measured. From the charge amount measured and the weight of the toner transferred, the charge amount was calculated.

Example 2

The preparation of magnetic core material and carrier and the evaluations were carried out in the same manner as in Example 1 except that the condition at the time of pulverizing the calcined product was changed. Here, the (1-1) pulverization of calcined product of Example 1 was changed as follows. That is, after pulverizing to an average particle diameter of about 5 μm over 6 hours by using a dry media mill (vibration mill, ⅛ inch diameter stainless steel beads), water was added to the obtained product, and further pulverization was carried out by using a wet media mill (horizontal bead mill, 1 mm diameter zirconia beads) for 4 hours. The resulting slurry was squeezed and dehydrated by a screw press machine, water was added to the cake, and pulverization was carried out by using the wet media mill (horizontal bead mill, 1 mm diameter zirconia beads) again for 4 hours to obtain Slurry 2. The particle size (volume average particle diameter of the pulverized material) of Slurry 2 was measured by Microtrack, and $D_{50}$ thereof was found about 2 μm.

Example 3

The preparation of magnetic core material and carrier and the evaluations were carried out in the same manner as in Example 1 except that the condition at the time of pulverizing the calcined product was changed. Here, the (1-1) pulverization of calcined product of Example 1 was changed as follows. That is, after pulverizing to an average particle diameter of about 5 pin over 6 hours by using a dry media mill (vibrating mill, ⅛ inch diameter stainless steel beads), water was added to the obtained product, and further pulverization was carried out by using a wet media mill (horizontal bead mill, 1 mm diameter zirconia beads) for 6 hours, to thereby obtain Slurry 3. Simultaneously with pulverization, the slurry during pulverization was subjected to concentration by cross flow filtration and addition of water. The particle size (volume average particle diameter of the pulverized material) of Slurry 3 was measured by Microtrack, and $D_{50}$ thereof was found about 2 μm.

Example 4

The preparation of magnetic core material and carrier and the evaluations were performed in the same manner as in Example 1, except for using a raw material of a different lot.

Example 5

The preparation of magnetic core material and carrier and the evaluations were performed in the same manner as in Example 2, except for using a raw material of a different lot.

Example 6

The preparation of magnetic core material and carrier and the evaluations were performed in the same manner as in Example 3, except for using a raw material of a different lot.

Example 7 (Comparative Example)

The preparation of magnetic core material and carrier and the evaluations were carried out in the same manner as in Example 1 except that the condition at the time of pulverizing the calcined product was changed. Here, the (1-1) pulverization of calcined product of Example 1 was changed as follows. That is, after pulverizing to an average particle diameter of about 5 μm over 6 hours by using a dry media mill (vibration mill, ⅛ inch diameter stainless steel beads), water was added to the obtained product, and further pulverization was carried out by using a wet media mill (horizontal bead mill, 1 mm diameter zirconia beads) for 6 hours, to thereby obtain Slurry 7. The particle size (volume average particle diameter of the pulverized material) of Slurry 7 was measured by Microtrack, and $D_{50}$ thereof was found about 2 μm.

Example 8 (Comparative Example)

The preparation of magnetic core material and carrier and the evaluations were performed in the same manner as in Example 7, except for using a raw material of a different lot.

Example 9 (Comparative Example)

The preparation of magnetic core material and carrier and the evaluations were carried out in the same manner as in Example 1 except that the condition at the time of pulverizing the calcined product was changed. Here, the (1-1) pulverization of calcined product of Example 1 was changed as follows. That is, after pulverizing to an average particle diameter of about 5 μm over 6 hours by using a dry media mill (vibration mill, ⅛ inch diameter stainless steel beads), water was added to the obtained product, and further pulverization was carried out by using a wet media mill (horizontal bead mill, 1 mm diameter zirconia beads) for 3 hours. The resulting slurry was squeezed and dehydrated with a belt press machine, water was added to the cake, and again pulverized for 2 hours by using the wet media mill (horizontal bead mill, 1 mm diameter zirconia beads). The obtained slurry was again squeezed and dehydrated with the belt press, water was added to the cake, and further pulverization was carried out by using the wet media mill (horizontal bead mill, 1 mm diameter zirconia beads) for 3 hours to obtain Slurry 9. The particle size (volume average particle diameter of the pulverized material) of Slurry 9 was measured by Microtrack, and $D_{50}$ was found about 2 μm.

Example 10 (Comparative Example)

The preparation of magnetic core material and carrier and the evaluations were carried out in the same manner as in Example 1 except that the sintering condition (firing temperature) was changed. Here, the (1-3) sintering was carried out with the conditions as follows. That is, a fired product was obtained by holding for 5 hours in a tunnel electric furnace at a firing temperature of 1,110° C. and an oxygen concentration of 0.6% by volume.

Example 11 (Comparative Example)

The preparation of magnetic core material and carrier and the evaluations were carried out in the same manner as in Example 1 except that the sintering condition (firing temperature) was changed. Here, the (1-3) sintering was carried out with the conditions as follows. That is, a fired product was obtained by holding for 5 hours in a tunnel electric furnace at a firing temperature of 1,280° C. and an oxygen concentration of 0.6% by volume.

Results

In Examples 1 to 11, the evaluation results obtained were as shown in Tables 1 and 2. In Examples 1 to 6, which are Inventive Examples, the environmental variation ratio of the electric resistance (A/B) was small, compression breaking strength ($CS_{ave}$) was excellent, and the compression breaking strength variation coefficients ($CS_{var}$) was also small. On the other hand, in Examples 7 and 8, which are Comparative Examples, Expression (1) was excessively large, and as a result, inferior environmental variation ratios (A/B) of the electric resistance was exhibited. On the other hand, in Example 9, which is Comparative Example, Expression (1) was excessively small, and as a result, inferior compression breaking strength variation coefficient ($CS_{var}$) was exhibited. In Example 10, which is Comparative Example, since the BET specific surface area was large, the average compression breaking strength was low; and in Example 11, low carrier charge amount was exhibited. From these results, it has been found that according to the present invention, a magnetic core material for electrophotographic developer and a carrier for electrophotographic developer, which have a small change of the electric resistance caused by environmental variation and excellent strength and charge imparting ability, and with which a satisfactory image without defects, and a developer containing the carrier, can be provided.

TABLE 1

| | $D_{50}$ | AD | Pore volume | BET specific surface area | Anion content (ppm) | | | | | | Expression | Expression | Cation content (%) | | | |
|---|---|---|---|---|---|---|---|---|---|---|---|---|---|---|---|---|
| | | | | | $F^-$ | $Cl^-$ | $Br^-$ | $NO^-_2$ | $NO_3^-$ | $SO_4^{2-}$ | | | | | | |
| | (μm) | (g/cm³) | (mm³/g) | (m²/g) | (a) | (b) | (c) | (d) | (e) | (f) | (1) | (2) | $Li^+$ | $Na^+$ | $K^+$ | $Ca^{2+}$ |
| Ex. 1 | 38.3 | 2.21 | 12 | 0.16 | 7.2 | 37.4 | N.D. | 0.1 | 0.4 | 191 | 572.7 | 565.0 | <0.01 | <0.01 | <0.01 | 0.05 |
| Ex. 2 | 38.3 | 2.19 | 10 | 0.14 | 5.8 | 50.3 | N.D. | 0.2 | 0.3 | 243 | 752.3 | 746.0 | <0.01 | <0.01 | <0.01 | 0.06 |
| Ex. 3 | 38.4 | 2.18 | 12 | 0.15 | 5.7 | 27.0 | N.D. | 0.2 | 0.5 | 743 | 1019.4 | 1013.0 | <0.01 | <0.01 | <0.01 | 0.04 |
| Ex. 4 | 38.6 | 2.22 | 11 | 0.15 | 6.1 | 54.3 | N.D. | 0.2 | 0.4 | 97 | 646.7 | 640.0 | <0.01 | 0.01 | <0.01 | 0.03 |
| Ex. 5 | 38.5 | 2.22 | 17 | 0.16 | 4.9 | 24.1 | N.D. | 0.1 | 0.2 | 393 | 639.2 | 634.0 | <0.01 | 0.01 | <0.01 | 0.03 |
| Ex. 6 | 38.8 | 2.20 | 13 | 0.17 | 5.5 | 14.4 | N.D. | 0.1 | 0.5 | 487 | 637.1 | 631.0 | <0.01 | <0.01 | <0.01 | 0.05 |
| Ex. 7* | 38.3 | 2.19 | 13 | 0.16 | 6.7 | 72.8 | N.D. | 0.3 | 0.6 | 702 | 1437.6 | 1430.0 | <0.01 | 0.02 | <0.01 | 0.07 |
| Ex. 8* | 38.5 | 2.23 | 10 | 0.17 | 6.1 | 39.9 | N.D. | 0.2 | 0.4 | 963 | 1368.7 | 1362.0 | <0.01 | 0.01 | <0.01 | 0.06 |
| Ex. 9* | 38.5 | 2.20 | 11 | 0.14 | 5.8 | 21.3 | N.D. | 0.1 | 0.3 | 65 | 284.2 | 278.0 | <0.01 | <0.01 | <0.01 | 0.04 |
| Ex. 10* | 39.2 | 2.01 | 39 | 0.31 | 7.3 | 44.6 | N.D. | 0.1 | 0.5 | 221 | 674.9 | 667.0 | <0.01 | 0.01 | <0.01 | 0.06 |
| Ex. 11* | 38.7 | 2.35 | 4 | 0.05 | 6.6 | 31.1 | N.D. | 0.1 | 0.1 | 111 | 428.8 | 422.0 | <0.01 | <0.01 | <0.01 | 0.04 |

*indicates Comparative Example.

N.D. stands for "non-detected"

TABLE 2

| | Electric resistance of core material (Log Ω) | | | | Compression breaking strength of core material | | Electric resistance of carrier (Log Ω) | | | | Carrier |
|---|---|---|---|---|---|---|---|---|---|---|---|
| | L/L (A) | N/N | H/H (B) | A/B | Average (mN) | Variation coefficient (%) | L/L (C) | N/N | H/H (D) | C/D | charge amount (μC/g) |
| Ex. 1 | 8.9 | 8.4 | 7.2 | 1.24 | 283 | 17 | 9.4 | 9.1 | 7.7 | 1.22 | 48.9 |
| Ex. 2 | 8.8 | 7.8 | 6.5 | 1.35 | 284 | 25 | 9.3 | 8.4 | 7.1 | 1.31 | 48.1 |
| Ex. 3 | 8.9 | 7.7 | 6.4 | 1.39 | 295 | 23 | 9.6 | 8.2 | 6.9 | 1.39 | 45.6 |
| Ex. 4 | 9.0 | 8.4 | 7.2 | 1.25 | 286 | 22 | 9.6 | 9.1 | 7.6 | 1.26 | 46.7 |
| Ex. 5 | 9.1 | 8.2 | 7.0 | 1.30 | 300 | 26 | 9.8 | 8.7 | 7.4 | 1.32 | 46.0 |
| Ex. 6 | 8.5 | 8.0 | 6.8 | 1.25 | 288 | 25 | 9.1 | 8.5 | 7.7 | 1.26 | 47.4 |
| Ex. 7* | 9.8 | 8.6 | 6.4 | 1.53 | 295 | 21 | 10.4 | 9.1 | 6.8 | 1.53 | 44.4 |
| Ex. 8* | 9.2 | 7.5 | 6.1 | 1.51 | 284 | 21 | 9.7 | 8.0 | 6.6 | 1.47 | 44.8 |
| Ex. 9* | 9.0 | 8.2 | 7.5 | 1.20 | 297 | 46 | 9.6 | 8.7 | 8.0 | 1.20 | 48.5 |
| Ex. 10* | 9.3 | 8.8 | 7.5 | 1.24 | 193 | 24 | 9.7 | 9.2 | 7.9 | 1.23 | 45.4 |
| Ex. 11* | 9.1 | 8.7 | 7.5 | 1.21 | 348 | 19 | 10.0 | 9.5 | 8.3 | 1.20 | 34.7 |

*indicates Comparative Example.

INDUSTRIAL APPLICABILITY

According to the present invention, a magnetic core material for electrophotographic developer which has a small change of the electric resistance caused by environmental variation and excellent strength and charge imparting ability, and with which a satisfactory image can stably be obtained when being used for a carrier, the carrier for electrophotographic developer, and a developer containing the carrier can be provided.

While the present invention has been described in detail with reference to specific embodiments, it will be apparent to those skilled in the art that various changes and modifications can be made without departing from the spirit and scope of the invention.

This application is based on Japanese Patent Application (No. 2017-000286) filed on Jan. 4, 2017, the contents of which are incorporated herein by reference.

The invention claimed is:

1. A magnetic core material for electrophotographic developer, satisfying a value of Expression (1): a +b [[]] □10+c +d +e +f, being from 300 to 1,300, when an amount of fluorine ion is denoted by a (ppm), an amount of chlorine ion is denoted by b (ppm), an amount of bromide ion is denoted by c (ppm), an amount of nitrite ion is denoted by d (ppm), an amount of nitrate ion is denoted by e (ppm), and an amount of sulfate ion is denoted by f (ppm), which are measured by combustion ion chromatography; and having a BET specific surface area being from 0.06 to 0.25 $m^2/g$.

2. The magnetic core material for electrophotographic developer according to claim 1, wherein the magnetic core material has a ferrite composition comprising Fe, Mn, Mg, and Sr.

3. The magnetic core material for electrophotographic developer according to claim 1, wherein the value of Expression (1) is from 400 to 1,200.

4. The magnetic core material for electrophotographic developer according to claim 1, wherein the BET specific surface area of from 0.08 to 0.22 $m^2/g$.

5. A carrier for electrophotographic developer comprising the magnetic core material for electrophotographic developer as described in claim 1 and a coating layer comprising a resin provided on a surface of the magnetic core material.

6. A developer comprising the carrier as described in claim 5 and a toner.

* * * * *